US008235143B2

(12) United States Patent
Tseytlin

(10) Patent No.: US 8,235,143 B2
(45) Date of Patent: Aug. 7, 2012

(54) METHODS AND DEVICES FOR DETERMINATION OF GAS-KICK PARAMETRS AND PREVENTION OF WELL EXPLOSION

(76) Inventor: Simon Tseytlin, Middle Village, NY (US)

( * ) Notice: Subject to any disclaimer, the term of this patent is extended or adjusted under 35 U.S.C. 154(b) by 24 days.

(21) Appl. No.: 13/045,730

(22) Filed: Mar. 11, 2011

(65) Prior Publication Data

US 2012/0006613 A1 Jan. 12, 2012

Related U.S. Application Data

(60) Provisional application No. 61/361,636, filed on Jul. 6, 2010.

(51) Int. Cl.
*C09K 8/02* (2006.01)

(52) U.S. Cl. ..... 175/48

(58) Field of Classification Search ..... 181/106; 367/25–27; 175/48
See application file for complete search history.

(56) References Cited

U.S. PATENT DOCUMENTS

| | | | | |
|---|---|---|---|---|
| 4,134,100 | A * | 1/1979 | Funke | 367/83 |
| 4,273,212 | A | 6/1981 | Dorr | |
| 5,006,845 | A * | 4/1991 | Calcar et al. | 367/81 |
| 5,070,949 | A * | 12/1991 | Gavignet | 175/48 |
| 5,130,950 | A * | 7/1992 | Orban et al. | 367/34 |
| 5,163,029 | A * | 11/1992 | Bryant et al. | 367/83 |
| 5,222,048 | A * | 6/1993 | Grosso et al. | 367/32 |
| 6,371,204 | B1 * | 4/2002 | Singh et al. | 166/250.03 |
| 7,334,651 | B2 * | 2/2008 | Wu | 175/48 |
| 8,077,545 | B2 * | 12/2011 | Heigl | 367/35 |
| 2009/0059720 | A1 * | 3/2009 | Heigl | 367/35 |

FOREIGN PATENT DOCUMENTS

EP 621397 A1 * 10/1994

* cited by examiner

*Primary Examiner* — John Fitzgerald
(74) *Attorney, Agent, or Firm* — Boris Leschinsky

(57) ABSTRACT

Acoustics-based methods and devices to characterize a gas kick during drilling an oil, gas, or gas condensate well are described. A pressure wave may be generated by abruptly changing the drilling mud pressure in the well, for example at the well head. The pressure wave is allowed to travel down the well, reflect from the well bottom and reach the well head again. Pressure is monitored during this process and a pressure peak is identified. The gas kick is characterized using the width of the pressure peak and time elapsed from the onset of pressure change and appearance of the peak. Negative pressure wave is preferred and may be generated by opening of a fast-acting valve located in the outlet pathway of the drilling mud fluid.

19 Claims, 4 Drawing Sheets

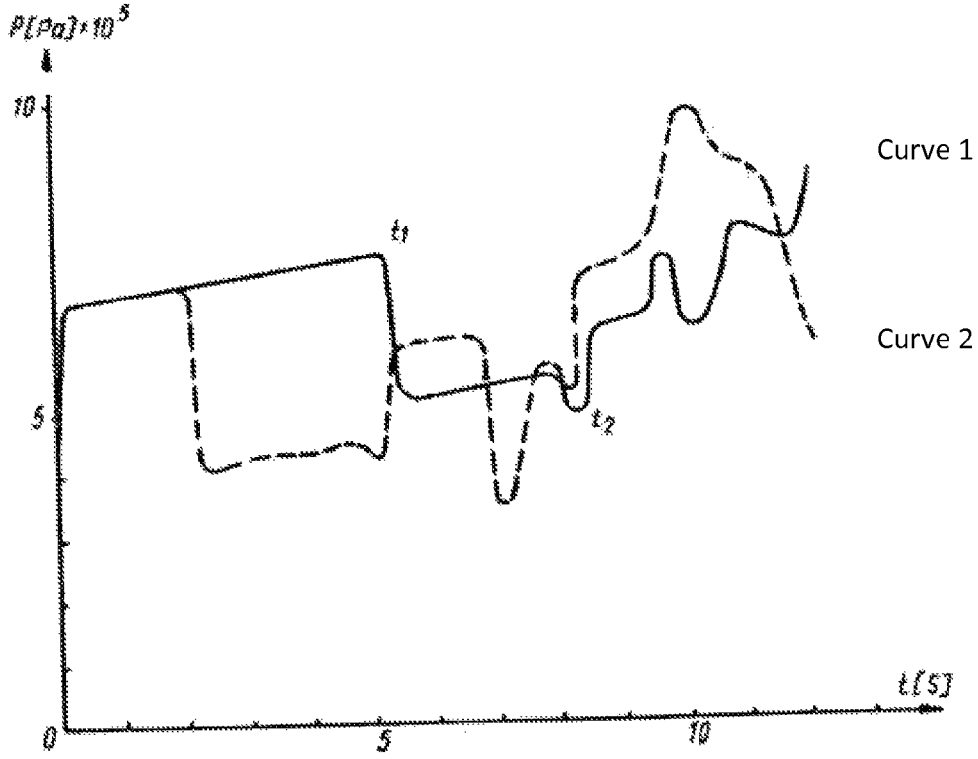
Fig.2
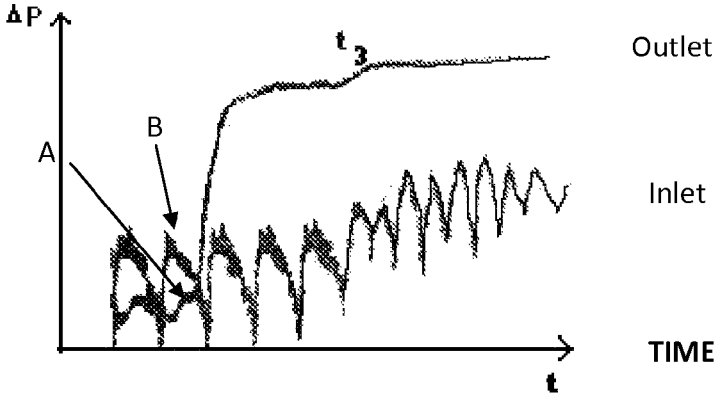
Fig.3.1

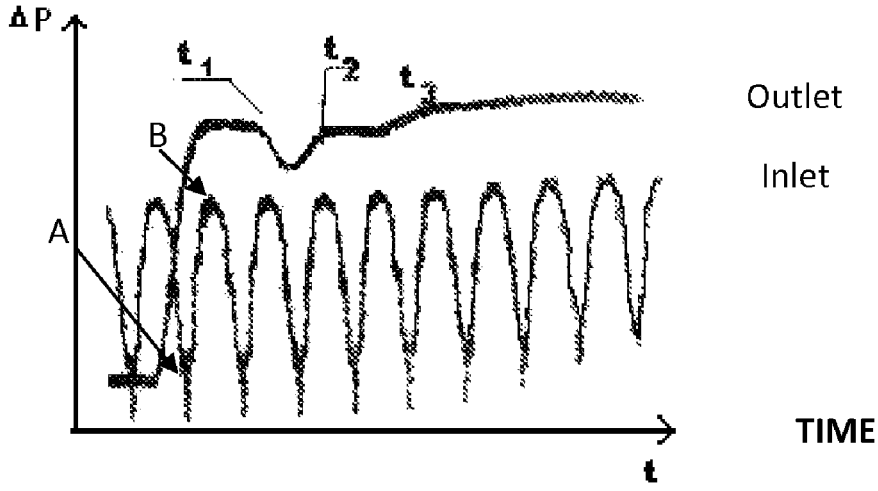
Fig.3.2
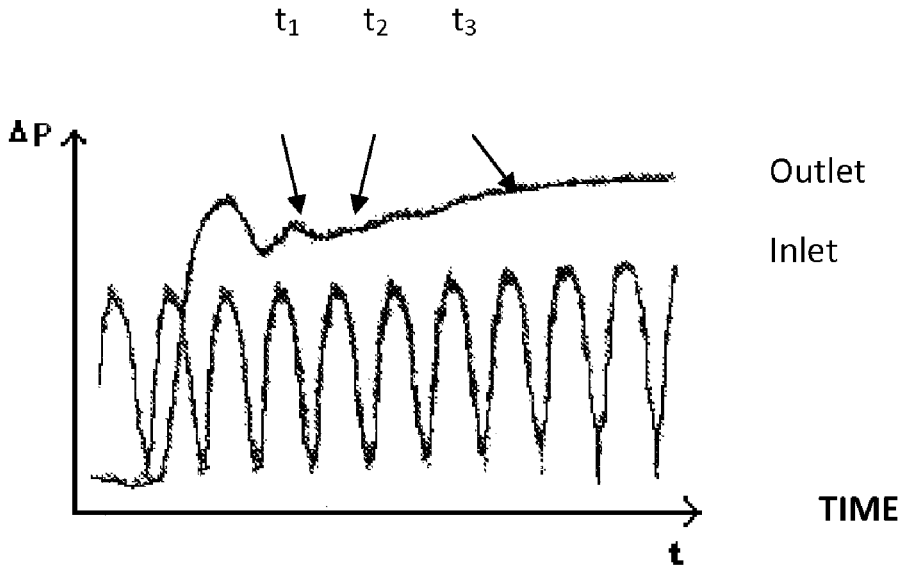
Fig.3.3

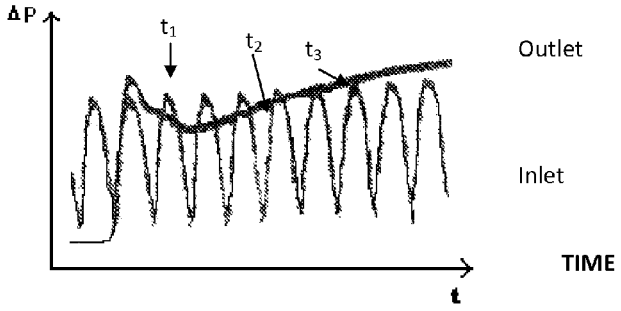
Fig.3.4
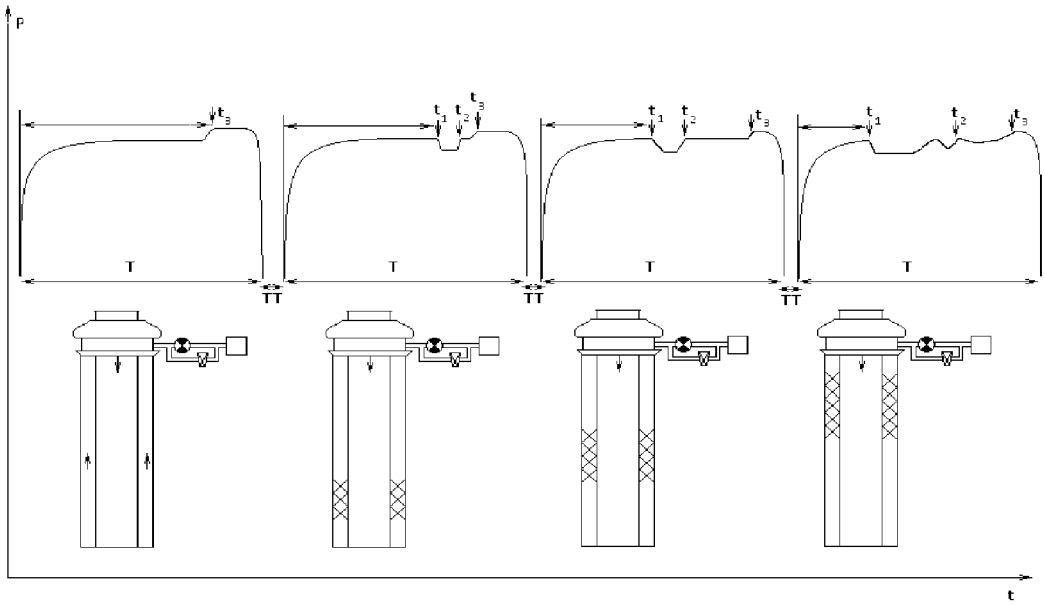
Fig.4

METHODS AND DEVICES FOR DETERMINATION OF GAS-KICK PARAMETRS AND PREVENTION OF WELL EXPLOSION

CROSS-REFERENCE DATA

The invention claims a priority benefit from a U.S. Provisional Patent Application No. 61/361,636 with the same title filed 6 Jul. 2010, which is incorporated herein in its entirety by reference.

FIELD OF THE INVENTION

The invention in general relates to the drilling of oil or gas wells, and particularly to the acoustic detection of a gas kick and removing it for an oil or gas well.

BACKGROUND

In the drilling of an oil, gas or gas condensate wells, drilling fluid referred to in the industry as "mud", is pumped into the drill pipe where it proceeds out through the drill bit and up the annular space between the drill pipe and the walls of the hole and further up the annular space between the drill pipe and the casing generally used, after which it is examined at the surface for certain parameters, processed and returned to circulation. The purpose of the circulating mud is to clean, cool and lubricate the bit, flush to the surface the cuttings from the bore hole and to protect the walls of the hole until casing is inserted. The density and viscosity of the mud is carefully controlled at the surface so as to contain various pressures encountered in the hole.

As the well is drilled, gases saturated in highly pressurized fluids may be released therefrom or from a porous rock and find their way into the circulating mud forming an annular gas bubble or a gaseous pack, also called a gas kick. This gas kick may ascend to the surface, result in a modification of the buoyancy of the drilling string and can cause extensive damage if it goes undetected. The gas or liquid contained in the gas kick reduces the hydrostatic head in the annulus. If the volume of the gas kick is not excessive and if it can be detected, gas kick removal procedures may be instituted so that drilling operations may proceed with minimal disruption.

It is known in the art of drilling of oil wells that gas kicks may contain pure natural gas or may alternately contain a certain percentage of water and/or oil. All of these occurrences are referred to for the purposes of this description as a "gas kick". Rising gas kick replaces drilling mud as it ascends to the surface of the well. This in turn leads to a decrease in a well bottomhole pressure which leads to a further increase of speed of gas kick ascendance. If not detected early, this may lead to catastrophic consequences. Sometimes a gas kick may even cause an uncontrolled blowout, which has been known to cause loss of human lives, extensive equipment damage, fires, environmental catastrophe and possible release of noxious gases.

Using acoustics for detection of the gas kick presence is known in the art. U.S. Pat. No. 4,273,212 for example discloses sending an acoustic pulse down the pipe and receive its reflection in the annular portion of the well head. Using high frequency positive acoustic pulses however does not allow full characterization of the gas kick as it only allows detection of its upper end and not allows detection of its lower end which is needed to detect its total volume. The size of a gas kick directly relates to the degree of damage that it can do when such gas kick reaches the surface. In addition, frequent pulses may not reach deep enough into the well as the dense drilling mud causes them to attenuate at fairly shallow depths. Using positive pressure pulses may also increase the risk of well rupture and therefore should be avoided if possible. Finally, continuous generation of the probing signals makes it difficult to separate them from the reflected signals.

Accordingly, reliable and safe methods and devices for detecting and fully characterizing the initial gas kick and its subsequent removal are desired.

SUMMARY

Accordingly, it is an object of the present invention to overcome these and other drawbacks of the prior art by providing novel methods and devices for identifying and monitoring the appearance and ascend of a gas kick in a well.

It is another object of the invention to increase the efficiency of gas kick detection and accuracy of determination for gas kick parameters such as its volume, position in the well and the speed of ascending to the surface so as to decrease the probability of explosion and an uncontrollable gas kick blowout expansion.

It is a further object of the invention to provide methods and devices for detection and full characterization of a gas kick in a well without increasing the well pressure and therefore without increasing the risk of well rupture.

The present invention provides acoustics-based methods and devices for early detection of a forming gas kick as well as for continuous characterization of its changing parameters during its ascend to the surface, including its size, position along the well, gas content, speed of movement and a projected time of arrival to the surface. Negative pressure shock wave is periodically generated by abrupt reduction in the resistance to the drilling mud outflow from the well, such negative pressure wave is allowed to travel down the bore. Its propagation along the well is recorded and features characterizing the presence of transitions between mud and gas are identified, including an upper transition and a lower transition indicating the upper and lower ends of a gas kick. Identifying such transitions further indicate the location of a gas kick along the well.

Accurate and reliable knowledge of these parameters is critical in taking timely steps to compensate for the presence of a gas kick leading to reducing and ultimately eliminating the risk of an uncontrolled blowout of the well.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

FIG. 2 shows results of a computer simulation for pressure waves propagation in wells under different conditions;

FIGS. 3.1 through 3.4 show changing pressure curves for the well outlet pressure as the gas kick ascends to the surface;

FIG. 4 shows another embodiment of the invention in which the pressure wave is sent down the drilling pipe and returned in the annular space.

DETAILED DESCRIPTION OF THE PREFERRED EMBODIMENTS OF THE INVENTION

Figure 1:
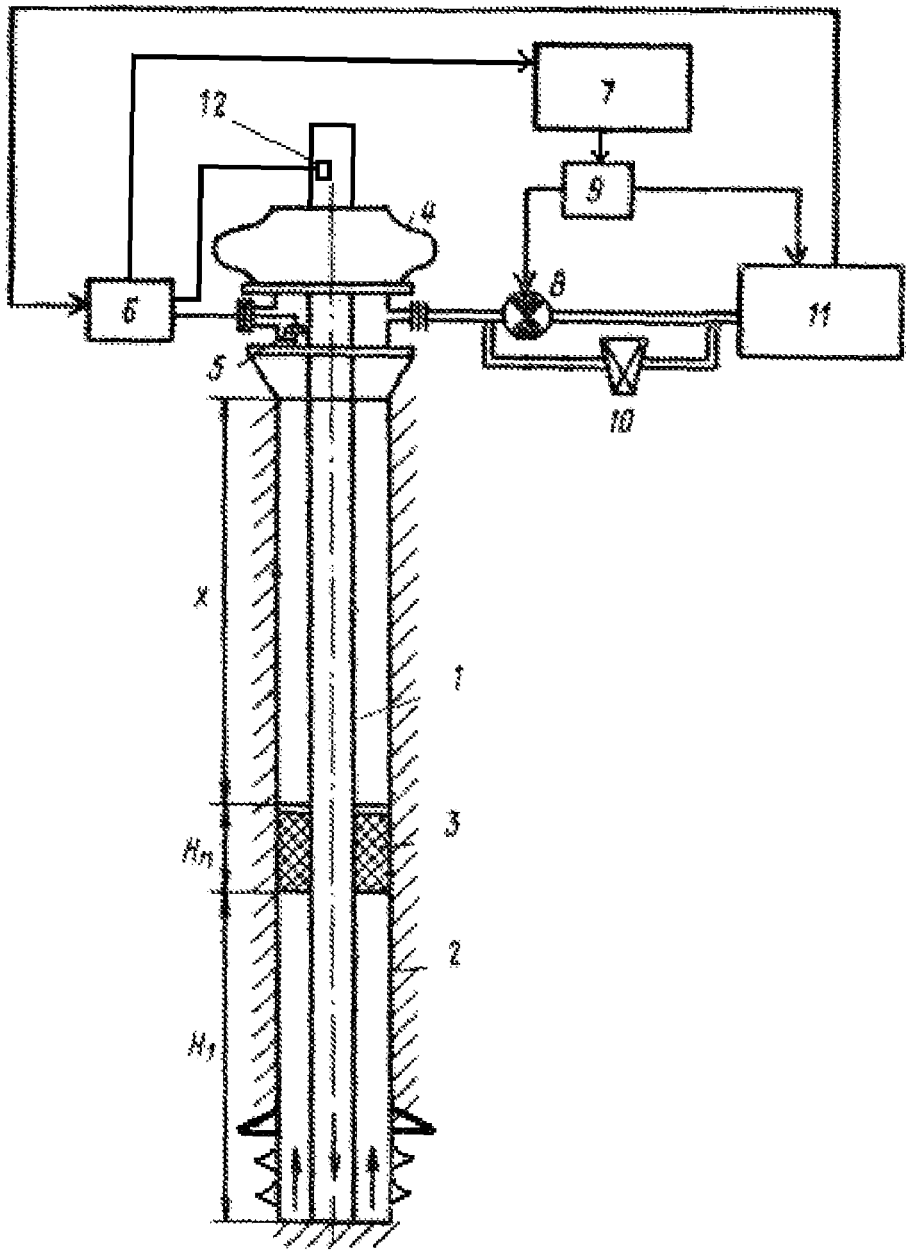
FIG. 1 a general depiction of an oil well containing an ascending gas kick as well as a block diagram of the device of the present invention.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

A well equipped with the system of the invention is depicted in FIG. 1. It includes a well casing 2 with a drilling pipe 1 located inside and forming an annular space therebetween. The lower end of the well with the drill bit attached to the pipe 1 is not shown. A blowout preventer (BOP) 4 is shown placed on top of the well at the point of a wellhead. An outgoing well pressure sensor 5 is located in the vicinity of the wellhead outlet allowing monitoring of drilling mud outlet pressure as it leaves the well. The optional incoming pressure sensor 12 is located at the inlet of the wellhead to monitor inlet pressure of the drilling mud as it is being forced down the drilling pipe 1. The signals from both pressure sensors 5 and 12 are fed into a data acquisition unit 6, which in turn is connected to a central processing unit (CPU) 7 based for example on a laptop PC.

The gas kick volume in the annular space is shown as position 3. It is characterized by its height $H_n$, distance from the wellhead X and distance from the reservoir $H_1$.

Other components of the system of the invention include a fast-acting on/off valve 8 activated by a valve driver 9 based on a control signal from the CPU 7. The valve 8 may be preferably located between the drilling mud collecting reservoir 11 and the exit from the annular space of the well or at any other surface location after the exit from the well. In embodiments, the valve 8 may also be placed inside the well. Rapid opening and closing of the valve 8 allows reducing abruptly the flow resistance in the outgoing pathway of the drilling mud. In order to not block the flow of drilling mud entirely when the valve 8 is closed, a parallel pathway or a bypass pipe around the valve 8 may be provided which may include an adjustable flow restrictor 10. In other embodiments of the invention (not shown), the valve 8 may include provisions to be rapidly opened and closed but to not completely obstruct the flow of the drilling mud. Such provisions may include an adjustable valve seat (chock). Moving the seat away from the valve stem leaves certain space rendering the valve 8 somewhat incompetent.

The method of the invention describes generating a single negative pressure wave for gas kick characterization so as not to confuse generated and reflected signals. As a result of valve 8 being abruptly opened, the flow resistance is suddenly reduced causing a rapid drop in mud pressure. The rapid drop generates a negative pressure shock wave which travels down the annular space of the well with a speed of sound, typically 1200-1500 meters per second. For the purposes of this invention, the change in pressure may be accomplished within a period of time of about 1/20 to about 1 second. In embodiments, that range may also be about 1/10 to 3/10 of a second. The difference between the initial or first pressure of the fluid in the well (such as drilling mud) may be about 1 to 5 atmospheres. The valve 8 may be kept open to maintain the low mud pressure for a period of time long enough to allow the negative pressure wave to travel down the well and return back up. In some embodiments, this time ranges from about 1 to about 20 seconds, while in other embodiments this time may be from about 5 to about 10 seconds. Deeper wells may require longer opening times, while shorter wells may need shorter times. The step of characterizing a gas kick with generating a single pressure shock wave may be repeated from time to time to monitor the changing condition of the gas kick in the well. As pressure disturbance generates multiple reflection waves, repeating the step of generating a negative pressure wave may be done after sufficient time have elapsed from the previous measurement to allow these reflection waves to attenuate and the pressure in the well to stabilize and return to a steady state. In embodiments, such period of time may be about 1 to about 60 minutes, preferably from about 5 to about 30 minutes. Unsteady pressure in the well at the beginning of the process may lead to an erroneous reading.

If the pressure wave encounters a gas kick on the way down, two reflected waves are generated, one at the upper end of the gas kick and one at the lower end of the gas kick. The upper end of the gas kick constitutes a point of transition of density from a high level of mud to a low level of gas. The lower end of the gas kick is characterized by the opposite transition of density—from low of gas to high density of mud. Data acquisition unit 6 may be configured for detecting the times of arrival of reflected waves $t_1$, $t_2$, and $t_3$. As seen in the FIGS. 2 and 3.1, $t_1$ is the time of arrival of the first reflected wave from the upper end of the gas kick; $t_2$ is the time of arrival of the second wave reflected off the lower end of the gas kick, and $t_3$ is the time of arrival of the reflected wave from the well bottom. Transition point from harder or denser medium to a less dense medium causes a change in pressure on the pressure curve in one direction, while a transition from less dense to a more dense medium caused a change in the pressure in the other direction.

FIGS. 3.1 to 3.4 show one example of ascending gas kick along the well. Shown in these figures is a reversed chart of the pressure in the well. When a negative pressure wave is generated, it is represented as a positive rise in pressure. As can be seen in FIGS. 2 to 4, $t_1$ is indicative of the upper end of the gas kick because the pressure curve shows a decline at this point. An increase to the initial level is indicative as the end of the gas kick at $t_2$ as the mud pressure returns to the previous level. Reflection of the pressure wave off the well bottom (which is harder than mud) causes a further rise in reflected pressure wave at $t_3$.

In one embodiment, the method of the invention includes the steps of:

a. creating at least once or in other embodiments repeatedly (such as on a periodic basis) an abrupt change (increase or decrease) in mud pressure from a first pressure level to a second pressure level so as to generate a pressure shock wave, b. maintaining the mud pressure at the second pressure level for a period of time sufficient for the pressure shock wave to travel down towards the bottom of the well and return back to the surface, c. monitoring pressure to follow pressure wave propagation along the well to detect wave reflections as it travels down and then up the well. Presence of a pressure peak indicates the presence of a gas kick, and d. characterizing the gas kick using the peak in pressure. The width of the peak on the pressure-time curve may be used to compute the size (or the length) of the gas kick. The time from the onset of pressure change may be used to calculate the location (depth) of the gas kick in the well.

In embodiments, an expanded method of the invention may include these steps:

a. continuously or periodically monitoring incoming and outgoing drilling mud pressures—for example using the pressure sensors 5 and 12 as shown in FIG. 1. Special attention may be given to monitor the noise fluctuations within the overall pressure signal from the sensors 5 and 12. These fluctuations may be caused by pressure disturbance generated by the pump used for injecting the drilling mud down the pipe 1, FIG. 1. The frequency of such fluctuations is close to that of the operation of the pump pistons. A typical example of such recording is shown in FIG. 3.1. Initial amplitude of noise fluctuations is monitored throughout the drilling process, b. detecting initial appearance of a gas kick within the annular space of the well by detecting an abrupt reduction of noise amplitude at the exit of the well (such as detected using pressure sensors 5 and/or 12). Gas dampens these pulsations and causes a smoothing out of the pressure signal at the outlet of the well. Amplitude reduction can be seen clearly by comparing section A, the very left portion of the outlet pressure curve in FIG. 3.1 and FIG. 3.2. Two pulsations are seen in section A in FIG. 3.1 and no pulsations are seen in section A in FIG. 3.2. Additional optional indication of the presence of the gas kick is absence of high frequency pulsations on the inlet pressure curve. These high frequency and low amplitude pulsations are caused by the operation of the pump valves. They can be seen in section B of the inlet pressure curve in FIG. 3.1. In comparison, the same section B in FIG. 3.2 shows a smooth inlet pressure curve without the impact of the pump valves;

c. closing the blowout preventer and initiating corrective measures once the initial entrance of the gas kick is detected. Optional continuous or periodic evaluations of circulation of the drilling mud through the device of the invention located at the outlet of the well allows continuous, periodic or near-continuous monitoring of the location and parameters of the gas kick;

d. creating a negative pressure shock wave on the outlet (or the inlet in other embodiments) of the well by rapidly opening a previously closed fast-acting valve 8, FIG. 1, whereby causing a significant increase in cross-sectional area available for drilling mud flow. This in turn causes a rapid decrease in flow resistance aimed to generate a negative pressure shock wave at the outlet of the well. The valve 8 is then closed again. The timing and speed of opening and closing the valve 8 are predetermined and calculated to achieve desirable characteristics of the negative pressure shock wave. The duration of valve 8 opening may be about 5-10 seconds. Generation of the negative pressure wave may occur every 5-10 min. Positive pressure wave may be used as well, but using negative pressure wave is safer as it does not load the components of the system with additional pressure. Another advantage of using the negative pressure well is not needing additional pressurization means for generating high pressure. The higher the speed of operating for valve 8, the higher is the sensitivity of the method of the invention. In one example, the valve 8 allows full opening in about 0.1 second. This high speed of opening creates a rapid enough disturbance of the outlet pressure curve to characterize gas kicks as little as only 25-30 feet long or greater. The present invention is not limited to the time when the drilling mud pumps are operating which is a common limitation of many other techniques. In fact, even when the pumps are not working, periodic rapid opening and closing of the valve 8 allows evaluation of the well and characterizing of the gas kick based on the pressure energy of the compressed oil and gas located in the reservoir itself. Ascending gas kick causes pressure increase at the wellhead even when the pumps are not operating. Such pressure increase (caused by gaseous pack moving up towards the wellhead) creates enough energy to repeat well evaluations by rapid opening and closing of the valve 8 without external pressure sources.

To create a negative pressure wave front at the inlet of the well, the pressurized flow of drilling mud may be temporarily diverted to a bypass accumulator and then gradually returned to the well. It can also be accomplished by interruption of pumping using other mechanical means—not shown in the drawings;

e. causing propagation of the negative pressure wave front down the well and recording its reflections at the wellhead. The negative pressure wave from the valve 8 travels down the annular space of the well with the speed generally equal to the speed of sound, about 1200-1500 meters per second. Upon reaching the gas kick, this wave is reflected both from its upper end and its lower end, such reflected waves are then recorded and analyzed to characterize the gas kick itself. Importantly, accurate detection of pressure waves reflected from the upper end and the lower end of the gas kick allow determination of the gas kick location and size;

f. repeating measurements of the gas kick location and size using steps (d) and (e) to determine the gas kick speed of ascending and to estimate its arrival to the surface of the well;

g. optionally determining the average gas content of the gas kick from the previously detected parameters of the gas kick and from the known difference between the flow rate of the drilling mud going down the pipe and the flow rate of the drilling mud coming out of the annular space.

The method of the invention further allows active detection of the lack of gas kick when the reflection of the negative pressure wave will only occur at the bottom of the well with the known depth—see FIG. 3.1. In this case, only one reflected wave is detected as without the gas kick there are no reflections from its upper end and its lower end. Additional reflections may occur at the locations where components of well casing are connected together but these locations are known in advance and their position is not changing over time making them easy to separate from the signature of a gas kick. It also allows determining the sound velocity in the drilling mud with high accuracy.

EXAMPLE 1

FIG. 2 shows one example of using the method of the invention using a simulated model of the well. Well depth is assumed at 5,000 meters, with a cross-sectional area of 0.01 $m^2$. A 500 meter long gas kick is assumed to be located at the depth of 3,750 meters. It had a gas content of 0.35. Opening valve 8 is assumed to be completed in 0.1 seconds causing an increase in cross-sectional area available for drilling mud flow from 0.0003 $m^2$ to 0.003 $m^2$. Such rapid increase in flow cross-section generates about 6 atmosphere negative pressure wave ($6\times10^5$ Pa).

Curve 1 in FIG. 2 shows the time of arrival $t_1$ to be about 5.8 seconds, while $t_2$ is about 8.3 seconds. Assuming the speed of sound in liquid at 1300 meters per second and in gas at 400 meters per second, the depth of location of the gas kick is calculated at 3,770 meters and its length at 510 meters, both numbers being accurate to about 2% to the target parameters defined above. Curve 2 shows well characterization and another position of the gas kick.

Further evaluations using this mathematical model have indicated that the method of the invention allows accurate characterization of a gas kick with the gas content ranging from 100% (only gas is present in the gas kick) down to 0% (gas kick contains only oil).

EXAMPLE 2

Another example is shown in FIGS. 3.1 to 3.4. FIG. 3.1 shows results of the evaluation without a gas kick present. Time $t_3$ corresponds to the location of the bottom of the well.

FIG. 3.2 shows initial position of the gas kick. Outlet pressure wave depression between points $t_1$ and $t_2$ indicates the length of the gas kick, while the position of the point $t_1$ indicates its depth. FIG. 3.3 and FIG. 3.4 show subsequent evaluations made in 20 and 35 min after the first detection of the gas kick. Point $t_1$ is seen moving progressively to the left and closer to the point of initial rise in pressure indicating ascendance of the gas kick. The distance between points $t_1$ and $t_2$ is seen progressively increasing indicating an increase in the length of the gas kick.

FIG. 4 illustrates another embodiment of the invention in which the pressure shock wave is sent through the drilling pipe. The pressure wave is reflected off the bottom of the well and travels back up again. The left panel shows the pressure chart indicating no gas kick is present—only one upwards inflection is seen at the time $t_3$. The next panel to the right shows the typical pressure curve when gas kick appears in the annular space. An inversed peak appears and it is closely located near the time $t_3$. The two panels on the right show the typical pressure curves as the gas kick ascends to the surface—the space between times $t_1/t_2$ and time $t_3$ is increased showing the increased distance between the gas kick and the bottom of the well. Also of note is the increased difference between the time $t_1$ and the time $t_2$ indicating the increased length of the gas kick in the well as it ascends to the surface.

Periodic calibration of the device of the invention may be performed once every few days using a simulator or by following the following procedure: close the blowout preventer for a short period of time and fully open the adjustable flow restrictor 10 shown in FIG. 1. The flow restrictor 10 is then is closed in predetermined steps, for example its cross-section available for flow is reduced by 1-3 mm at a time. Each time the flow through the restrictor is reduced, a pressure wave is created. If the closure of the flow restrictor cannot be performed fast enough to cause the pressure wave, the fast-acting valve 8 may be used for that purpose. Once a reliable picture of the waves reflected from the well bottom is seen, the flow restrictor adjustment is stopped and the calibration is complete. As the optimal flow capacity of the flow restrictor 10 depends on the depth of the well and the pumping capacity of the drilling mud pumps among other factors, conducting such procedure on a periodic basis allows maintaining the device continuously calibrated. This avoids the need to spend time on a calibration procedure when the presence of the gas kick is already determined or suspected using this or other known gas kick detection methods.

The method of the invention allows not only monitoring the progress of ascendance of the gas kick but also calculating mud density, pump flow rate and other parameters needed for its successful elimination. One of conditions needed for successful removal of a gas kick from a well is to maintain the bottomhole pressure near the portion of the well without a casing at appropriate levels. These levels should be below the reservoir fraction pressure (tear-out threshold) but above the pressure at which gas comes out of formation solution to well. This in turn allows for reliable prevention of uncontrolled gas kick blowout, well explosions and improved safety of well operation. In particular this is important for offshore wells, where an explosion can lead to a serious catastrophe.

The method and the device of the invention may be used advantageously during so-called tripping operations with the well. It is known that pipes need to be lifted and removed from the well from time to time, for example to change the drilling bit or for other well maintenance purposes. The level of drilling mud and other liquids drops in the well as the pipes are being removed. Various hydraulic shocks associated with the procedure of pipe removal may cause well rupture. Gas kick may still appear in the well during this procedure. The method of the invention teaches periodic closure of the well and the blowout preventer, such as for example after removal of a few sections of the pipe. The level of drilling mud is topped off and the circulating pumps are activated, possibly at low pumping capacity. Opening of the valve 8 allows full detection of a gas kick as described above. If no gas kick is detected the tripping procedure may be resumed.

The method of the invention may also be used with certain modifications for other processes associated with oil and gas wells. In one embodiment, pouring cement down the well may be monitored using the method of the invention to assure no air or gas entrapment.

One more advantage of the invention is the ability to monitor and assure safety of operations when multiple wells are being drilled at the same time. Data collection may be conducted to feed signals from individual pressure monitors positioned on more than one well into a central location where data processing is conducted for all incoming signals. Centralization of safety monitoring function may assure increased safety of all operations associated with well drilling.

The herein described subject matter sometimes illustrates different components or elements contained within, or connected with, different other components or elements. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method for characterization of a gas kick within a fluid in a well comprising the steps of:

a. abruptly changing fluid pressure with a valve from a first pressure level to a second pressure level to generate a pressure shock wave, b. maintaining fluid pressure at said second pressure level for a period of time sufficient to allow said pressure shock wave to travel along said well, and c. monitoring said fluid pressure with sensors as a function of time from the onset of said change in fluid pressure and during the time of said pressure shock wave traveling along said well, and d. characterizing said gas kick using a pressure peak in said fluid pressure.

2. The method as in claim 1, wherein said second pressure level is lower than said first pressure level, whereby said pressure shock wave is a negative pressure shock wave.

3. The method as in claim 1, wherein in step (d) a length of said gas kick is characterized using a width of said peak in said fluid pressure.

4. The method as in claim 1, wherein in step (d) a depth of location of said gas kick is characterized using a time elapsed between onset of said pressure change and said peak in fluid pressure.

5. The method as in claim 1, wherein said steps (a) through (c) are repeated from time to time to monitor said well for appearance or ascendance of said gas kick.

6. The method as in claim 1, wherein the difference between said first pressure and said second pressure is about 1 to about 5 atmospheres.

7. The method as in claim 1, further including monitoring pressure fluctuations caused by operation of a fluid pump, wherein a presence of said gas kick is detected when amplitude of said fluctuations is reduced.

8. The method as in claim 1, wherein said fluid is a drilling mud and said fluid pressure is an outlet pressure of said drilling mud exiting said well.

9. The method as in claim 8, wherein said drilling mud is located in an annular space formed between a drilling pipe and a well casing in said well.

10. The method as in claim 1, wherein said step (b) of maintaining said fluid pressure at said second level is maintained for a period of time to allow said pressure wave to reach a well bottom and return to a well head, said fluid pressure being returned to said first level thereafter.

11. The method as in claim 10, wherein said period of time is about 5 to about 10 seconds.

12. The method as in claim 1, wherein said step (a) is accomplished within a time period of about 1/20 to about 1 second.

13. The method as in claim 12, wherein said step (a) is accomplished within a time period of about 1/10 to about 3/10 of a second.

14. A system for characterizing a gas kick in a well, said well including a casing and a drilling pipe located therein and forming an annular space therebetween, said system comprising:

an outlet pressure sensor configured to monitor drilling mud pressure exiting said annular space of said well, a fast-acting valve located in an outlet pathway of said drilling mud, said fast-acting valve operated by a valve driver, a control system configured to monitor drilling mud pressure using said outlet pressure sensor, said control system connected to said valve driver and configured to cause said driver to open said fast-acting valve for a period of time sufficient to generate and propagate a negative pressure wave down said well, reflect from a well bottom and reach a well head, wherein said gas kick is characterized using a peak in pressure recorded when said negative pressure wave is traveling along said well.

15. The system as in claim 14, wherein said fast-acting valve is configured to be opened in about 1/10 to 3/10 of a second.

16. The system as in claim 14, wherein said fast-acting valve includes a bypass pipe having a flow restrictor.

17. The system as in claim 16 wherein said flow restrictor is adjustable.

18. The system as in claim 14, wherein said fast-acting valve is sized to allow rapid drop in pressure of said drilling mud when said valve is opened by said valve driver.

19. The system as in claim 18, wherein said drop in pressure is about 1 to 5 atmospheres.

* * * * *